US005350171A

United States Patent [19]

Wozniak

[11] Patent Number: 5,350,171

[45] Date of Patent: Sep. 27, 1994

[54] METHOD AND APPARATUS FOR PLAYING A POCKET BILLIARD GAME

[75] Inventor: Thomas J. Wozniak, Akron, Ohio

[73] Assignee: Grand Prix Billiards, Inc., North Royalton, Ohio

[21] Appl. No.: 771,453

[22] Filed: Oct. 2, 1991

[51] Int. Cl.[5] ..... A63D 15/00

[52] U.S. Cl. ..... 473/1

[58] Field of Search ..... 273/2, 269, 260, 261, 273/126 R, 258, 272

[56] References Cited

U.S. PATENT DOCUMENTS 1,443,266 1/1923 King ..... 273/3 R
4,004,804 1/1977 Gholson ..... 273/59 R
5,039,099 8/1991 Bravo ..... 273/2

FOREIGN PATENT DOCUMENTS 392471 5/1933 United Kingdom ..... 273/126 R
2097682 11/1982 United Kingdom ..... 273/126 R

OTHER PUBLICATIONS

"The Way We Play", 1975, pp. 190–197, 184.

*Primary Examiner*—Theatrice Brown

[57] ABSTRACT

Disclosed is a pocket billiard game in which players alternately must contact any one of a first collection of substantially indistinguishable object balls and, if successful, must contact a particular ball of a second collection of numbered balls. Further disclosed is a method for avoiding entirely the spotting of object balls and a method by which a player may earn through skill the right to begin pocket billiard games subsequent to a first game. Further disclosed is a set of pocket billiard object balls suitable for playing the disclosed game containing a first collection of eight balls of solid color and a second collection of eight striped balls bearing distinct numeral markings.

13 Claims, 2 Drawing Sheets

METHOD AND APPARATUS FOR PLAYING A POCKET BILLIARD GAME

BACKGROUND OF THE INVENTION

1. Field of the Invention

This invention relates to a pocket billiard game played on a conventional table with a novel set of balls and rules devised to increase competitiveness and spectator interest.

2. Description of the Prior Art

Pocket billiards is conventionally played on a generally rectangular table having a playing surface twice as long as it is wide. Six pockets are provided, one at each of the four corners of the rectangle and one at each center of the two long boundaries, or rails, of the table. Varying numbers of balls, identical in diameter and small enough to be able to enter pockets smoothly, are utilized as targets. In general, one ball, commonly white and known as the cue ball, is propelled by being struck by an instrument known as the cue stick. The usual object of pocket billiard games is to cause the cue ball to contact one or more of the other balls, known as object balls, and further cause one or more object balls to enter pockets.

Numerous pocket billiard games are known in the prior art. Many are described in *The Official Rule Book for All Pocket & Carom Billiard Games*, published in Chicago by the Billiard Congress of America in 1974 ("BCA 74"). Still others are described in *Billiards: The Official Rules & Records Book*, published by the Billiard Congress of America, 1700 First Avenue, Eastdale Plaza, Iowa City, Iowa 52240, in 1990 ("BCA 90"). Billiard terms and games referred to herein, unless otherwise specified, are to be understood as defined in BCA 90. All the pocket billiard games mentioned herein, as well as the present invention, utilize a cue ball in addition to the object balls described.

Several of the most popular spectator pocket billiard games are Nine-Ball, Eight-Ball and Snooker. Efforts have been made to expose these games to a wide television audience, but each suffers from competitive drawbacks that reduce audience interest.

Nine-Ball is played with nine object balls, labeled with the numerals 1 through 9 and racked at the foot of the table in the form of a diamond. The ball nearest the center of the table, called the "apex ball", is positioned on the foot spot. The opening shot, or break shot is played forcefully with the goal of scattering the balls widely and pocketing at least one of them. This is known as an "open break" and at least four object balls must contact some cushion for the shot to be legal. The player who is successful at pocketing a ball on the break shot may continue playing. At each shot, the player's cue ball must first contact the lowest-numbered ball remaining on the table. The player who first pockets the Nine-Ball legally is the winner of the "rack". A Nine-Ball match is won by the first player who wins a predetermined number of racks.

The skill of professional players at Nine-Ball is so high that there is a substantial chance that the player who opens the game will "run out", that is, pocket a ball on the break shot and then sink all the remaining object balls in numerical order and, thus, winning by pocketing the Nine-Ball last. Since the winner of a rack of Nine-Ball by the rules is allowed to open the next rack, a skilled player may win several games consecutively without the opponent having a single opportunity to shoot. This aspect of the game reduces competitiveness and exacts a heavy penalty for missing, since the opponent may win the match, or draw insurmountably ahead, when once given the chance to play.

From the spectator viewpoint, Nine-Ball provides little of the suspense believed necessary to sustain interest. Because the rules of the game dictate which ball is to be played next under all circumstances, there is no opportunity for the spectator to ponder or speculate on what shot the player will attempt. Furthermore, the relatively small number of balls used results in a rack of Nine-Ball lasting only a short time, typically from one to five minutes.

In Nine-Ball, a player who fouls by failing to contact the lowest-numbered ball on the tablet or who "scratches" by pocketing the cue ball is subjected to the severe penalty of "cue ball in hand", under which his turn at the table ends and the next player is permitted to place the cue ball anywhere on the table before shooting. The effect of this rule is that a single foul or scratch often leads to loss of the game by giving the opponent an overwhelming advantage.

Accordingly, it is an object of the present invention to offer a game that is more challenging than Nine-Ball and in which it is more difficult to run out. It is a further object of the present invention to reduce the cost of missing a shot by providing a game in which both players will have several opportunities to shoot during each rack. It is an additional object of the present invention to increase spectator suspense by allowing a player to have a choice of balls at which to play on at least a portion of his or her shots. It is still another object of the present invention to decrease the penalty associated with a foul in Nine-Ball, thereby increasing competitiveness.

Eight-Ball is the most popular pocket billiard game in the United States. It is played with a standard rack of 15 object balls placed in a triangle. Of these, the balls numbered 1 through 7, inclusive, bear solid colors in addition to numerals and are known as "solids". The balls numbered 9 through 15, inclusive, bear visual stripes in addition to numerals and are known as "stripes". The Eight-Ball is solid black except for an area bearing the numeral "8". The balls are racked so that the apex ball lies on the foot spot. The opening player must attempt an open break. When a player legally pockets a ball subsequent to the break shot, the "group", that is, stripes or solids, to which that ball belongs become that player's group for the remainder of the rack. A player must contact a ball of his or her group first every shot and keeps playing as long as a ball of that group is legally pocketed. Only when all the balls of a player's group have been pocketed may that player attempt to pocket the Eight-Ball. The player who first legally pockets the eight-ball is the winner. The break shot on subsequent racks alternates between players, regardless of who won the preceding rack.

Because the balls of a player's group, that is, stripes or solids, need not be contacted or pocketed in any particular order, the player at the beginning of a rack has numerous balls at which to play and may plan a sequence leading to a runout. Therefore, Eight-Ball suffers from the same deficiency as Nine-Ball in that the chance of a runout is high and the penalty for a foul is cue ball in hand, by which competitiveness is reduced.

Accordingly, it is an object of the present invention to offer a game that is more challenging than Eight-Ball and in which it is more difficult to run out. It is a further object of the present invention to provide a game in which the right to break the subsequent rack can be earned, offering more suspense to the spectator and affording a player who is behind in the score a chance to secure the advantage of the break shot. It is an additional object of the present invention to soften the effect of the foul penalty in Eight-Ball.

Snooker is the most popular pocket billiard game in the United Kingdom and the Far East. It is played on a 12-foot table having narrow pockets and with 21 small object balls consisting of 15 solid red object balls and six other object balls (known in the UK as "colours") each of a different solid color. The 15 reds are racked in a triangle, while the colours are placed at the beginning of the game, or "frame", on predefined spots on the table. The general object of Snooker is pocket a red ball, then a colour, then another red ball and another colour, alternately, until no more red balls remain on the table. At that point, the colours must be pocketed in a predetermined order. Any colour pocketed immediately after a red is pocketed is returned to the table. A player receives one point for pocketing a red and a greater number of points for pocketing a colour. The colours, although the balls themselves do not bear numerals, are assigned point values from 2 to 7. Snooker possesses a complex system of penalties for infractions of the rules. For example, failing to contact a colour when required or failure to contact a red when required is a foul, for which from four to seven points is to be added to the opponent's score. The frame terminates when all balls have been pocketed. The player with the larger number of points at that time is the winner.

It is not regarded as advantageous to play a break shot in Snooker because of the low probability of pocketing a ball. Therefore, a frame of Snooker generally begins with positional maneuvering, in which the players attempt to leave the cue ball in a disadvantaged location for the opponent, rather than try to pocket a ball.

In contrast to Nine-Ball, which is too rapid, Snooker is too slow. Even if the players never miss a shot, 36 balls must be pocketed before the frame ends. (Fifteen reds, each followed by a colour, then followed by six colours in order.) With the narrow pockets, a single frame may take more than 30 minutes for professional players and considerably longer for beginners. Because points are awarded for defensive play, that is, placing the cue ball in such a position that the opponent cannot hit the required ball, stretches may occur in which the players are not even attempting to pocket a ball, which lengthens the game and causes tedium for players and spectators alike.

Accordingly, it is an object of the present invention to offer a game that is easier and faster than Snooker, uses fewer balls, eliminates the respotting of balls, and imposes a simpler scheme of fouls and penalties. It is a further object of the present invention to reduce defensive play during the opening shot sequence of the game. It is an additional object of the present invention to speed play by eliminating respotting of balls that have been pocketed.

Two other pocket billiard games, now obsolete, are described here because of their relation to the present invention. These games are described in BCA 74 but do not appear in BCA 90.

Poker Pocket Billiards is played with 16 object balls, composed of four sets of four balls, each labeled "A", "K", "Q" and "J". These designations are intended to represent the ace, king, queen and jack in a regular deck of playing cards. The balls are racked in a diamond shape with the apex ball at the foot spot. The goal is to form the best poker hand by sinking up to five balls in any turn. A player who has pocketed five balls in one turn may pocket additional balls, but must "spot" one, that is, return it to the table by placing it on the foot spot, for each additional ball pocketed, so the player is never credited with more than five balls during a turn. When all the balls have been pocketed, the player who is able to form the best poker hand from the balls that player has pocketed is the winner. Poker Pocket Billiards is not a challenging game for good players because of the substantial chance to pocket four aces and a king and, thus, guarantee winning by possessing the highest hand. The reason for the ease of play is that there is no restriction on which ball a player may shoot at next, having pocketed a ball.

Baseball Pocket Billiards is played with 21 object balls, numbered 1 through 21, which are racked in a triangle with the apex ball at the foot spot. Each player is given nine turns, or innings, at the table and may shoot until he or she fails to pocket a ball, which ends the player's inning. The first shot of each inning is a break shot and the player is credited with all balls pocketed. The player's score is increased by a number of "runs" equal to the numeral on each ball pocketed. At the beginning of each inning, all 21 balls are racked. The player with the greatest number of runs after all players have had nine innings at the table is the winner. Baseball Pocket Billiards is lengthy because of the number of balls on the table and the number of innings that must be played. A professional player can easily run out an entire rack after a break shot because there is no restriction on the choice of target available to a player at each shot.

Accordingly, it is an object of the present invention to increase the competitiveness of Poker Pocket Billiards and Baseball Pocket Billiards by reducing the number of options available to the player on certain shots.

In games utilizing an open break, it often occurs that the object balls cluster too closely near the cushion closest to the foot spot after the break. In all of the prior art games discussed above, the apex ball is racked on the foot spot. It is an object of the present invention to increase the availability of shot opportunities following a break shot.

SUMMARY OF THE INVENTION

Accordingly, I have invented a pocket billiard game, known as BLAZZ TM (pronounced "blaze"), to be played on a conventional pocket billiard table with ordinary cue sticks and a cue ball, but whose object ball set is composed of 16 balls, eight of which are of the same solid color and substantially indistinguishable from one another and eight of which are distinct and numbered with point values. In a preferred embodiment, the point values range from 11 to 18. The game consists of racking all sixteen balls and performing a break shot, on which the player is credited with any balls pocketed. Thereafter, the player must alternately contact a red ball, then the lowest-numbered ball, then a red ball, then the lowest-numbered ball, and so forth until the player fails to pocket a ball. The next player must take up the red/numbered sequence; for example, if the preceding player failed to pocket a numbered ball, then the subsequent player must attempt to pocket a numbered ball. Balls legally pocketed are not returned to the table during a rack.

For pocketing a solid ball, a player receives one point. For pocketing a numbered ball, a player receives that number of points designated by the numeral on that ball. By judicious choice of the range of numerals on the balls, the competitive characteristics of the game can be altered. For example, using high numerical values exacts a heavy price for missing a red ball, since the opponent is likely to then pocket a red and also a ball bearing a high number. Alternately, using low numerical values minimizes the strategic difference between solids and numbered balls.

By giving the player a choice of object balls when shooting at reds, a selection of positional opportunities is provided and the spectator interest increased because the player's next target is not predetermined as in Nine-Ball. By requiring the players to contact the numbered balls in sequential order, competitiveness is increased and the chance of a runout is reduced. By not returning legally pocketed balls to the table for any reason, the game is made faster than Snooker.

DETAILED DESCRIPTION OF THE INVENTION

Figure 1:
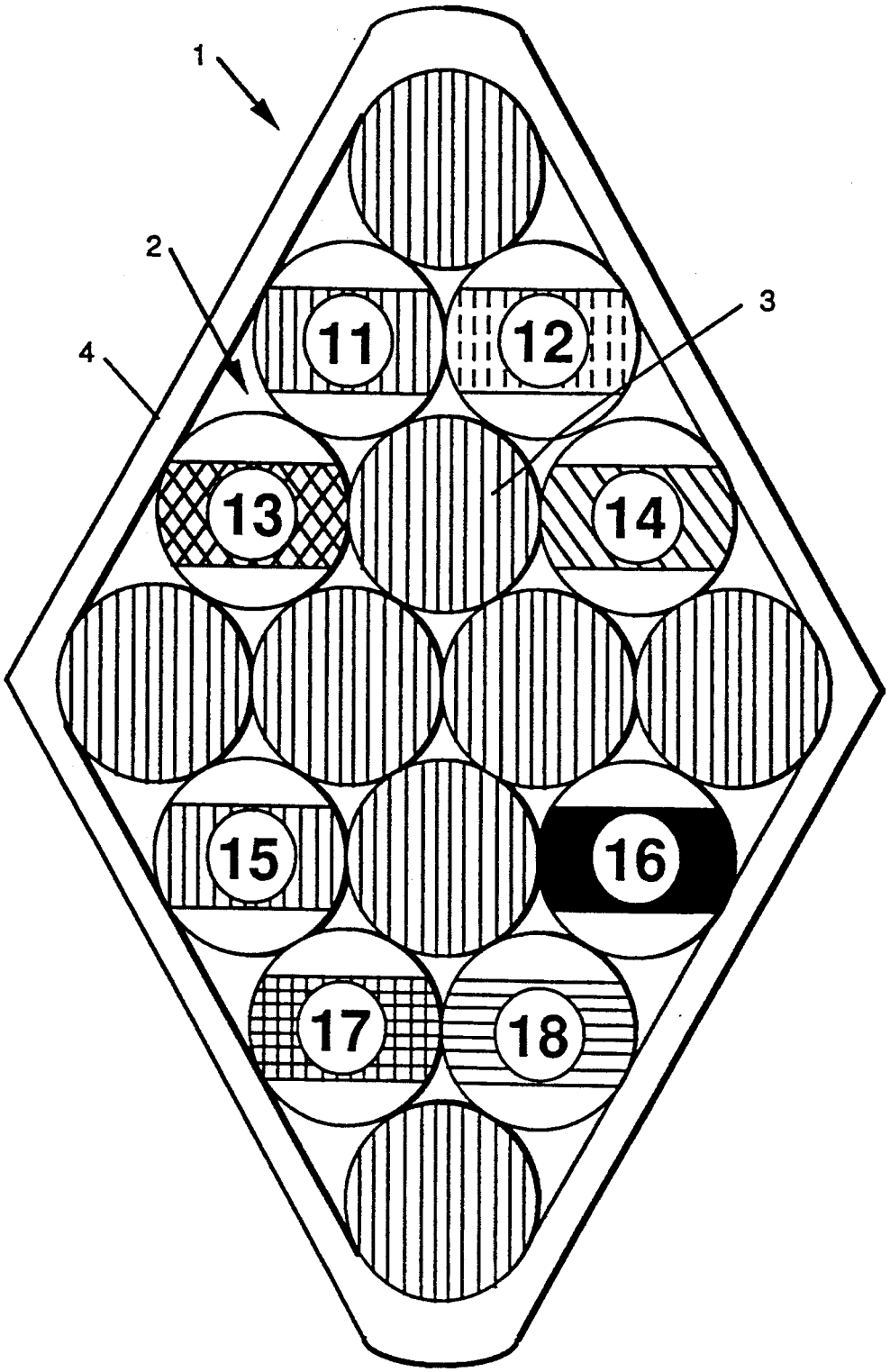
FIG. 1 is a top view, lined for color, of the preferred embodiment of a set of object balls used in conjunction with the present invention.

Referring now to FIG. 1, there is shown a set of game equipment 1 in a preferred embodiment of the present invention, and includes a set of sixteen pocket billiard balls 2 racked in a conventional diamond-shaped rack 4. The balls 2 include eight red balls and eight striped, numbered balls bearing the numerals 11 through 18, inclusive, racked as follows from left to right in each row: in the first row, a single red ball; in the second row, the eleven-ball and twelve-ball; in the third row, the thirteen-ball, a red ball 3 and the fourteen-ball; in the fourth row, four red balls; in the fifth row, the fifteen-ball, a red and the sixteen-ball, in the sixth row, the seventeen-ball and eighteen-balls, and in the last row a single red ball. The balls are marked in accordance with conventional coloring schemes. The eleven-ball is marked with a light red stripe, the twelve-ball is marked with a purple stripe, the thirteen-ball is marked with an orange stripe, the fourteen-ball with a green stripe, the fifteen-ball with a dark red stripe, the sixteen-ball with a black stride, the seventeen-ball with a yellow stripe and the eighteen-ball with a blue stripe. This color scheme is consistent with the conventional colors of balls numbered one through fifteen, in which balls whose numerical values differ by eight have the same color.

In an alternative embodiment, the eight numbered balls bear the consecutive even numerals 2 through 16, inclusive, and are racked analogously to the arrangement above, with 2 substituted for 11, and so forth. In a further alternative embodiment, the eight numbered balls bear the consecutive odd numerals 1 through 15, inclusive.

Figure 2:
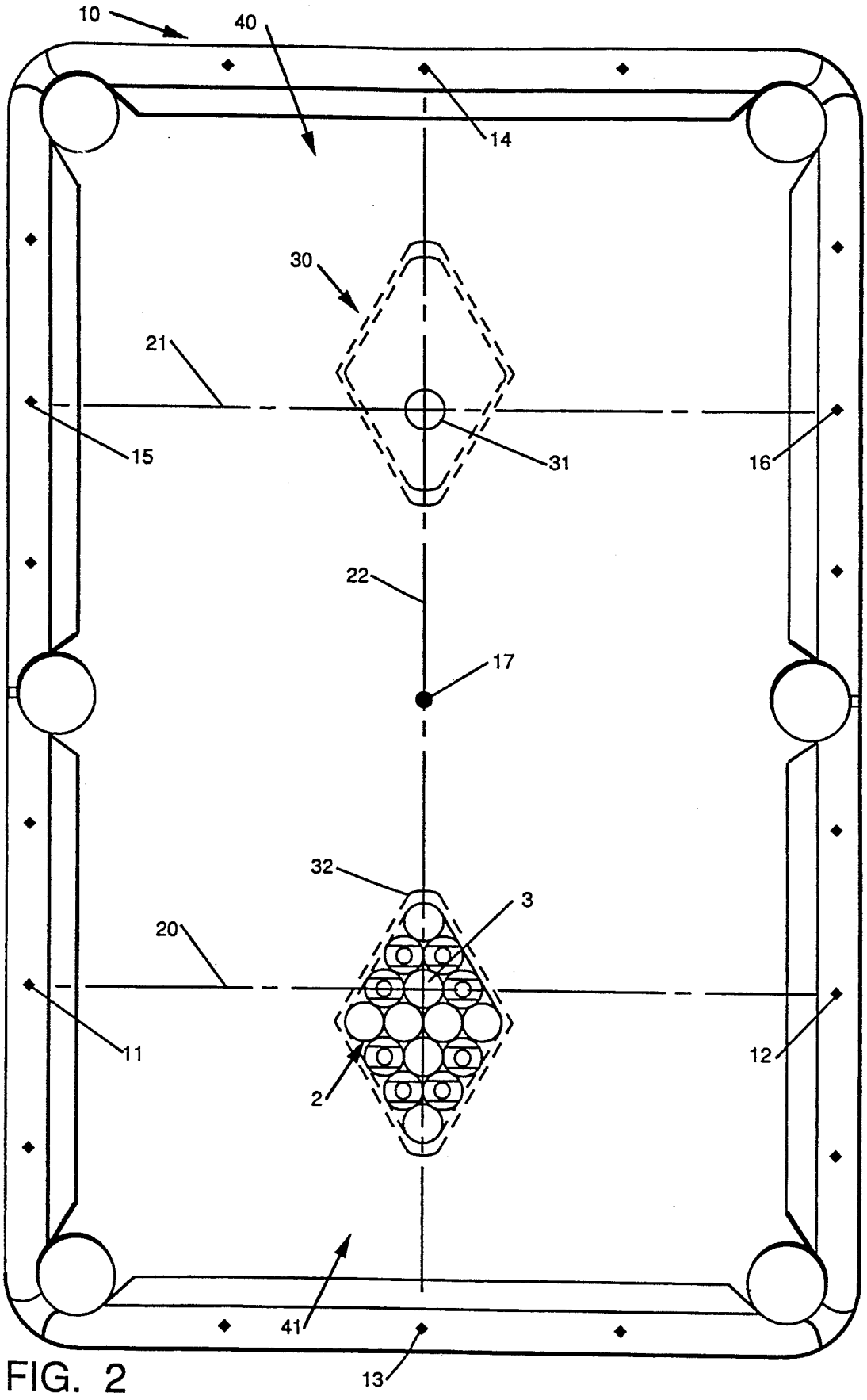
FIG. 2 is a top view of a conventional pocket billiard table illustrating the arrangement of balls at the start of the game of the present invention.

Referring now to FIG. 2, there is shown a conventional pocket billiard table 10 on which the game of the present invention can be played. Certain spots are used to play the game of the present invention, and should be marked with light pencil on the playing surface of the table. The head spot is at the intersection of the head string 21 joining the second left-side diamond 15 and second right-side diamond 16 as seen from the top rail, respectively, and the center string 22 joining diamonds 13 and 14, the center diamonds on the bottom and top rails, respectively. Diamond 14 is at the location of the table manufacturer's nameplate. The foot spot is at the intersection of the foot string 21 joining the second left-side diamond 11 and the second right-side diamond 12 as seen from the bottom rail, respectively, and the center string 22. The center spot 17 lies at the midpoint of the center string 22. The head area 40 lies above the head string 21. The foot area 41 lies between the foot string 20 and the bottom cushion. When the rack of balls is placed on the table at the start of the first game of a sequence, it is positioned over rack outline 32 and the balls placed therein in the configuration shown in FIG. 1, with red ball 3 of the third row lying directly over the foot spot.

At the head of the table is rack outline 30 in a position symmetrical with that of rack outline 32. Before the start of the game, the outside perimeters of rack outlines 30 and 32 should be marked lightly in pencil on the playing surface for later reference.

The game of the present invention may be played with two or more players. The order of play among the players is determined by lag or lot. The balls may be racked in the configuration 2 shown in FIG. 1 at either end of the table 10, within rack outline 30 or rack outline 32. A conventional cue ball 31 is shown in a legal position for a break shot. The configuration shown in FIG. 2 has the rack of balls 2 in rack outline 32 and the cue ball 31 in rack outline 30, although these positions could be reversed.

The player who is to open play places the cue ball 31 at any position within the unoccupied rack outline and then executes an open break but must first contact a red ball. The opening player is credited with the point values corresponding to any balls pocketed on the break shot, red balls being worth one point and each numbered ball being worth the number of points indicated by the numeral it bears. If the opening player pockets a ball, he or she may continue shooting according to the rules below.

If no ball is pocketed on the break, the opening player's turn ends and the incoming player (the next in order of play) may either accept the position of the balls or may execute a "rollout" if dissatisfied with the layout of the balls. A rollout is a conventional maneuver, known in Eight-Ball and Nine-Ball, in which no effort is made to pocket a ball, but in which the player attempts to move the cue ball to a more favorable position. After a rollout, the player's turn ends and the next player in order has the option of playing from the resulting position or requiring the player who rolled out to shoot from that position. If the opening player legally pockets a ball, the next player does not have the option of rolling out.

If the opening player pockets a ball on the break but is dissatisfied with the resulting position of the balls, the player may roll out. All rollouts must be called by announcing "rollout." Any ball pocketed on a rollout is credited to the opponent. All references herein to the crediting of a ball to an opponent shall mean crediting the ball to the incoming player.

If the opening player pockets any red ball on the break and does not elect to roll out, he or she must shoot at and contact the lowest-numbered ball next, even if one or more numbered balls were pocketed on the break. Failure to contact the lowest-numbered ball first is a foul. If the lowest-numbered ball is contacted and a ball is pocketed, the player continues shooting, and must next contact a red ball, pocket a ball on the same stroke, and so forth, alternating between red and numbered balls.

If the opening player pockets only red balls on the break, he or she must shoot at and contact the lowest-numbered ball on the next shot. It is a foul if the first ball contacted by the cue ball is not the lowest-numbered ball. If the lowest-numbered ball is contacted first and a ball is pocketed, either directly or by means of a combination shot, the player continues shooting, and must next contact a red ball, pocket a ball on the same stroke, and so forth, alternating between red and numbered balls.

In an embodiment intended for beginning players, when called upon to hit a numbered ball, a player may hit any numbered ball rather than being required to contact the lowest-numbered ball.

On all shots other than the break shots, the player must "call" (designate in advance of the shot) the ball that is to be pocketed and the pocket in which it will fall.

In one embodiment of the game of the present invention which is intended for players at a professional level of skill, whenever a player must contact a red ball, the player's turn ends unless a red ball is also pocketed. In the same professional embodiment, whenever a player must contact a particular numbered ball, the player's turn ends unless some numbered ball designated in advance by the player is pocketed. In amateur embodiments, any object ball designated in advance by the player may be pocketed provided that the required object ball is contacted first. In an embodiment intended for novice players, calling shots is not required.

Provided that a called ball is pocketed, the player is credited with all balls legally pocketed on the same stroke. If the player fails to pocket the called ball, the player's turn ends and any object balls pocketed on the stroke are credited to the incoming player. In an embodiment intended for novice players, the foregoing rule does not apply because calling of balls is not required.

The incoming player at his first shot of a turn must play at and contact the ball that the outgoing player was last obliged to play at.

The opportunity to open a rack, or break, is an advantage because of the possibility of pocketing a ball and thereby earning the right to continue playing. The break alternates among the players on successive racks, except that in the game of the present invention a player may "earn" the right to break as follows. Upon legally pocketing the last object ball of a rack, if the player is able to make the cue ball come to rest within either rack outline 30 or 32, that player wins the right to open the next rack with the cue ball in the position at which it came to rest. The object balls are racked in the rack area opposite to that in which the cue ball came to rest.

It is a foul if a player either (1) fails to contact a ball required to be hit, except on a permitted rollout; or (2) fails to cause a ball to contact a cushion following a contact between the cue ball and an object ball; or (3) scratches by pocketing the cue ball, contacting the cue ball more than once or causing the cue ball to come to rest off the playing surface; or (4) causes an object ball to come to rest off the playing surface; or (5) interferes with the balls by touching the cue ball with anything other than the tip of the cue stick or by touching any object ball. After a scratch, the incoming player may place the cue ball anywhere in the head area (if the balls were racked at rack outline 32) or anywhere in the foot area (if the balls were racked at rack outline 30).

If the player commits a foul, the player's turn ends and any object balls that were pocketed or that came to rest off the playing surface are credited to the opponent.

If the outgoing player fouled, the incoming player may either accept the balls as they lie (referred to as "table in position") and continue play or may compel the outgoing player to shoot again. If the player who is compelled to shoot again makes a legal shot, that player's turn continues. If a player fouls on three consecutive shots, without the opponent having attempted an intervening shot, the opponent is awarded cue ball in hand.

After interference, any balls pocketed as a result of the interference are credited to the next player following the interfering player. Object balls that leave the table for any reason are never returned to the table.

A player may attempt a deliberate defensive play by announcing "safety". If a ball is pocketed on a stroke on which a safety has been announced, it is credited to the opponent. In any event, the shot following a call of safety ends a player's turn at the table. If a player fouls on two consecutive shots, each following a legal safety by the opponent, the opponent is awarded cue ball in hand.

In situations not covered by the rules described herein, the "General Rules of Pocket Billiards" as listed in BCA 90 should be deemed to apply.

The pocket billiard game of the present invention may be scored cumulatively to a predetermined point total, the first player to reach at least that total being the victor, or may be scored by racks. When two players are playing, the first player to score more than half of the points available on a rack is the winner of the rack. A rack containing eight balls each worth one point and eight balls numbered from 11 to 18 permits a total of 124 points to be scored. Therefore, the first player to score at least 63 points is the winner of the rack. A rack that ends in a tie is replayed. If there are more than two players, that player having the highest point total after the last object ball has been pocketed is the winner. When scoring is by racks, the break shot alternates among the players in their order of shooting, unless the player who legally pockets the last object ball of a rack earns the right to break the next rack.

In an embodiment for amateur play, balls two and one-quarter inches in diameter are employed on standard four and one-half by nine foot table.

In an embodiment for professional play, balls two and one-quarter inches in diameter are employed on a five by ten foot table having side pockets of opening width not exceeding five inches and corner pockets of opening width not exceeding four and one-half inches. This is to increase the difficulty of shots, thus making the game more challenging.

The pocket billiard game of the present invention increases competitiveness and spectator interest over prior art pocket billiard games as follows.

1. Because 16 balls are used rather than nine, a rack lasts longer and a runout is more difficult in the game of the present invention than in the game of Nine-Ball.

2. Because the player has a choice of object balls when playing on solids, it is more difficult for the spectator to predict, as in Nine-Ball, which ball the player will next attempt.

3. Because the numbered balls must be contacted in numerical order rather than arbitrarily, the game of the present invention is more difficult than Eight-Ball and the chance of a runout is concomitantly reduced.

4. Because fewer balls are used and balls legally pocketed are not respotted, the game of the present invention is faster to play than Snooker.

5. Because all of the object balls in the game of the present invention are racked contiguously and subjected to an open break, a wider scatter of the balls is provided than in Snooker, with concomitant increase in speed of play.

6. Because scoring in the game of the present invention can be continued cumulatively over more than one rack, unlike in Snooker, differences in points scored more accurately reflect differences in playing skill, and, unlike Snooker, the game of the present invention can easily be handicapped to compensate for differences in the abilities of the players.

7. Because the game of the present invention awards no points for fouls or defensive play, its penalty structure is much simpler than that of Snooker and therefore, easier to learn and remember and easier for the spectator to understand with minimal explanation.

8. Because the point values of the numbered balls are substantially higher than the single point awarded for pocketing a solid, the player is encouraged to attempt to pocket balls rather than play defensively.

9. A player who is behind in the score of the game of the present invention may, through skill, earn the advantageous right to open the next game by positioning the cue ball into a rack outline on the last shot of the game. This contrasts with prior art games in which the breaking order is predetermined.

10. By requiring multiple fouls before exacting the ball in hand penalty, the game of the present invention introduces tactical choices not present in any prior art game and avoids the harsh cue ball in hand penalty associated with single fouls in such games as Eight-Ball and Nine-Ball.

Having described above the presently preferred embodiments of this invention, it is to be understood that the invention may be otherwise embodied within the scope of the appended claims.

I claim:

1. A method of playing pocket billiards with a cue ball on a pocket billiard table having pockets, comprising:

a) providing a collection of no more than 21 object balls, said collection having a predetermined set of equal valued balls and a predetermined set of differing valued balls;

b) arranging said object balls in a predetermined configuration upon the table, all said object balls in contact with at least two adjacent object balls;

c) alternately designating one of said two predetermined sets as a target set;

d) using movement of said cue ball to strike a ball in one of said two predetermined sets designated as said target set;

e) using movement of said cue ball to strike a ball in the other of said two predetermined sets so long as the preceding strike of the cue ball in step d) caused a ball in said target set to enter any of the pockets on the table, all object balls entering a pocket remaining in said pocket until all other object balls have been pocketed;

f) awarding a predetermined number of points for each ball pocketed from said equal valued set of balls and a number of points for each ball pocketed from said differing valued set of balls corresponding to the numerical point value associated with said ball;

g) repeating steps c) through f) until all of said object balls have been pocketed.

2. The method of playing pocket billiards according to claim 1, wherein at step d) and e) a player who must contact a ball from said differing valued set must contact that ball from said differing valued set having a lowest numerical point value of those balls of said differing valued set that have not yet been pocketed.

3. The method of playing pocket billiards according to claim 1, wherein at step a) said differing valued set comprises balls having numerical point values that are consecutive positive integers.

4. The method of playing pocket billiards according to claim 1, wherein at step a) said differing valued set comprises balls having numerical point values that are consecutive positive integers and all balls of said equally valued set are marked with the same solid color.

5. The method of playing pocket billiards according to claim 1, wherein at Step a) said differing valued set comprises balls having numerical point values that are consecutive odd positive integers or consecutive even positive integers and all balls of said equal valued set are marked with the same solid color.

6. A method as defined in claim 1, wherein said method comprises the further step inserted at any point following step e) of:

alternately performing the steps of c) through f) with one or more additional players in a rotational order of play.

7. A method as defined in claim 6, wherein a player uses said cue ball to strike a ball from the last said target set of the previous player in which no ball from the target set was pocketed.

8. A method as defined in claim 6, wherein said method comprises the further step inserted after step g) of:

h) determining as a winner that player who first achieves a predetermined value of points.

9. The method of playing pocket billiards according to claim 6, wherein at steps c) and d) a ball that is pocketed by a player but is not legally pocketed is credited to the next player in rotational order for the purpose of awarding points.

10. A method as defined in claim 1, wherein said method comprises the further step of:

providing a set of rules defining when an object ball has been legally pocketed by a player and any corresponding benefit to said player for legally pocketing said object ball;

for every object ball pocketed by a player, determining whether it has been legally pocketed according to said rules and awarding a resulting benefit to said player if said pocketed ball has been legally pocketed; and if according to said rules said pocketed object ball has not been legally pocketed, then awarding the resulting benefit had said pocketed object ball been legally pocketed to one or more players other than said player.

11. A method for one or more players to play pocket billiards with a cue ball on a pocket billiard table having pockets and a playing surface, comprising:

a) providing a collection of no more than 21 object balls, said collection having a predetermined set of equal valued balls and a predetermined set of differing valued balls;

b) providing a set of rules defining when an object ball is legally pocketed and when a winner is determined;

c) designated on said playing surface one or more racking areas for arranging said object balls when starting play;

d) assigning a rotational order of play to the players;

e) alternately designating one of said two predetermined sets as a target set;

f) using movement of said cue ball to strike a ball in one of said two predetermined sets designated as said target set;

g) using movement of said cue ball to strike a ball in the other of said two predetermined sets so long as the preceding strike of the cue ball in step f) caused a ball in said target set to enter any of the pockets on the table, all object balls entering a pocket remaining in said pocket until all other object balls have been pocketed;

h) awarding a predetermined number of points for each ball pocketed from said equal valued set of balls and a number of points for each ball pocketed from said differing valued set corresponding to the numerical point value associated with said ball;

i) repeating steps e) through h) until all of said object balls have been pocketed.

12. The method of playing pocket billiards as recited in claim 11, and comprising the further steps of:

j) allowing the player to begin contacting a new set of object balls who is next in assigned order that player who began contacting the preceding set of object balls, unless a last player who has legally pocketed the last object ball of said preceding set of object balls has caused said cue ball to come to rest within one of said racking areas, in which case said last player shall begin contacting said new set of object balls; and k) repeating steps e) through i) until predetermined point values have been attained, said winner determined as the first said player to attain said predetermined point value.

13. The method of playing pocket billiards according to claim 11, wherein at steps f) and g) a player who must contact a ball from said differing valued set must elect to shoot at that ball from said differing valued set having a lowest numerical point value of the unpocketed balls from said differing valued set.

* * * * *